US010119452B2

(12) United States Patent
Konishi

(10) Patent No.: US 10,119,452 B2
(45) Date of Patent: Nov. 6, 2018

(54) INTERNAL COMBUSTION ENGINE PROVIDED WITH COOLING WATER PASSAGE

(71) Applicant: HONDA MOTOR CO., LTD., Tokyo (JP)

(72) Inventor: Yukio Konishi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/600,952

(22) Filed: May 22, 2017

(65) Prior Publication Data

US 2017/0335744 A1 Nov. 23, 2017

(30) Foreign Application Priority Data

May 23, 2016 (JP) ..... 2016-102636

(51) Int. Cl.

| | |
|---|---|
| ***F01P 3/12*** | (2006.01) |
| ***F01P 3/02*** | (2006.01) |
| ***F01P 11/04*** | (2006.01) |
| ***F02B 75/22*** | (2006.01) |
| *F02B 75/18* | (2006.01) |

(52) U.S. Cl.

CPC ..... *F01P 3/12* (2013.01); *F01P 3/02* (2013.01); *F01P 11/04* (2013.01); *F02B 75/22* (2013.01); *F01P 2003/021* (2013.01); *F01P 2003/024* (2013.01); *F01P 2060/16* (2013.01); *F02B 2075/1824* (2013.01)

(58) Field of Classification Search

CPC ..... F01P 3/12; F01P 3/14; F01P 3/02; F01P 11/04

See application file for complete search history.

(56) References Cited

U.S. PATENT DOCUMENTS

2011/0252775 A1* 10/2011 Joergl ..... F01D 25/145 60/321
2016/0281582 A1* 9/2016 Hayman ..... B60K 11/02

FOREIGN PATENT DOCUMENTS

CN 204476536 U 7/2015
JP 4911229 B2 4/2012

* cited by examiner

*Primary Examiner* — Jacob Amick
(74) *Attorney, Agent, or Firm* — Armstrong Teasdale LLP

(57) ABSTRACT

An internal combustion engine includes: an engine body; an exhaust pipe fastened to the engine body; an engine body cooling water passage provided in the engine body and having a cooling water injection port and a cooling water discharge port; an exhaust pipe cooling water passage provided in the exhaust pipe; a supply passage that connects the engine body cooling water passage with the exhaust pipe cooling water passage such that cooling water flows from the engine body cooling water passage to the exhaust pipe cooling water passage through the supply passage; and a return passage that connects the engine body cooling water passage with the exhaust pipe cooling water passage such that the cooling water flows from the exhaust pipe cooling water passage to the engine body cooling water passage through the return passage.

6 Claims, 9 Drawing Sheets

INTERNAL COMBUSTION ENGINE PROVIDED WITH COOLING WATER PASSAGE

TECHNICAL FIELD

The present invention relates to an internal combustion engine provided with a cooling water passage.

BACKGROUND OF THE INVENTION

Internal combustion engines having an engine body cooling water passage provided in an engine body and an exhaust pipe cooling water passage provided in an exhaust pipe are known (see JP4911229B2 or CN204476536U, for example). In such internal combustion engines, the engine body and the exhaust pipe are cooled by cooling water flowing through the engine body cooling water passage and the exhaust pipe cooling water passage.

However, conventional internal combustion engines are configured such that cooling water is injected into and discharged from the exhaust pipe cooling water passage separately from the cooling water injected into and discharged from the engine body cooling water passage, and this makes it necessary to provide passages dedicated to the injection and discharge of the cooling water into and from the exhaust pipe cooling water passage, whereby the cooling water passage structure is complicated.

BRIEF SUMMARY OF THE INVENTION

In view of the foregoing background, a main object of the present invention is to provide an internal combustion engine having a simple cooling water passage structure.

To achieve the above object, one aspect of the present invention provides an internal combustion engine (1), including : an engine body (2); an exhaust pipe (21) fastened to the engine body; an engine body cooling water passage (31) provided in the engine body and having a cooling water injection port (36) and a cooling water discharge port (37); an exhaust pipe cooling water passage (38) provided in the exhaust pipe; a supply passage (33) that connects the engine body cooling water passage with the exhaust pipe cooling water passage such that cooling water flows from the engine body cooling water passage to the exhaust pipe cooling water passage through the supply passage; and a return passage (34) that connects the engine body cooling water passage with the exhaust pipe cooling water passage such that the cooling water flows from the exhaust pipe cooling water passage to the engine body cooling water passage through the return passage.

According to this structure, the cooling water is injected into the exhaust pipe cooling water passage of the exhaust pipe from the engine body cooling water passage and is discharged from the exhaust pipe cooling water passage to the engine body cooling water passage, and therefore, cooling water passages for directly injecting/discharging the cooling water into/from the exhaust pipe cooling water passage are unnecessary. Thus, an internal combustion engine having a simple cooling water passage structure is provided.

In the above structure, preferably, the engine body (2) includes an engine body fastening part (22) fastened to the exhaust pipe (21) and at least one exhaust port (13) opening out in the engine body fastening part; the exhaust pipe includes an exhaust pipe fastening part (23) fastened to the engine body and at least one exhaust branch passage (25) that opens out in the exhaust pipe fastening part and is in communication with the at least one exhaust port; the supply passage (33) and the return passage (34) are included in the engine body cooling water passage (31); the supply passage and the return passage open out in the engine body fastening part; and the exhaust pipe cooling water passage opens out in the exhaust pipe fastening part and is connected with the supply passage and the return passage.

According to this structure, because the supply passage and the return passage are configured to open out in the engine body fastening part, the cooling water flows between the engine body cooling water passage and the exhaust pipe cooling passage by pass through the engine body fastening part and the exhaust pipe fastening part.

In the above structure, preferably, the at least one exhaust port includes a plurality of exhaust ports (13) each opening out in the engine body fastening part; the at least one exhaust branch passage includes a plurality of exhaust branch passages (25) each opening out in the exhaust pipe fastening part and being in communication with a corresponding one of the exhaust ports; the exhaust branch passages are arranged along a cylinder row direction; the exhaust pipe includes an exhaust merging part (26) for merging exhaust flowing through the plurality of exhaust branch passages; and the exhaust merging part is provided between the exhaust pipe cooling water passage (38) and the engine body (2).

According to this structure, the exhaust branch passages and the exhaust merging part are cooled by the cooling water.

In the above structure, preferably, the exhaust pipe cooling water passage further includes at least one inter-branch cooling water passage (82) between each pair of adjoining exhaust branch passages (25).

According to this structure, the exhaust branch passages are cooled by the cooling water flowing through the inter-branch cooling water passages.

In the above structure, preferably, the at least one inter-branch cooling water passage (82) is configured to pass between the exhaust merging part (26) and the engine body (2).

According to this structure, the exhaust branch passages are cooled by the cooling water flowing through the inter-branch cooling water passages.

In the above structure, preferably, the supply passage is provided at a higher position than the cooling water injection port in a cylinder axis direction; the return passage is provided at a higher position than the supply passage in the cylinder axis direction; and the cooling water discharge port is provided at a higher position than the return passage in the cylinder axis direction.

According to this structure, the cooling water flows smoothly from below to up in the cylinder axis direction.

In the above structure, preferably, the exhaust pipe has a vertically symmetrical shape.

According to this structure, in a case where the engine includes two cylinder heads having mutually symmetrical structures, such as a case where the engine consists of a V-type engine, the exhaust pipe attached to one cylinder head can be attached to the other cylinder head without changing the direction in which the exhaust merging part of the exhaust pipe opens, by positioning the exhaust pipe upside down. Namely, exhaust pipes having an identical structure can be attached to the respective cylinder heads.

According to the foregoing arrangement, an internal combustion engine having a simple cooling water passage structure is provided.

DETAILED DESCRIPTION OF THE PREFERRED EMBODIMENTS

In the following, an internal combustion engine provided with a cooling water passage according to a preferred embodiment of the present invention will be described with reference to the appended drawings.

Figure 1:
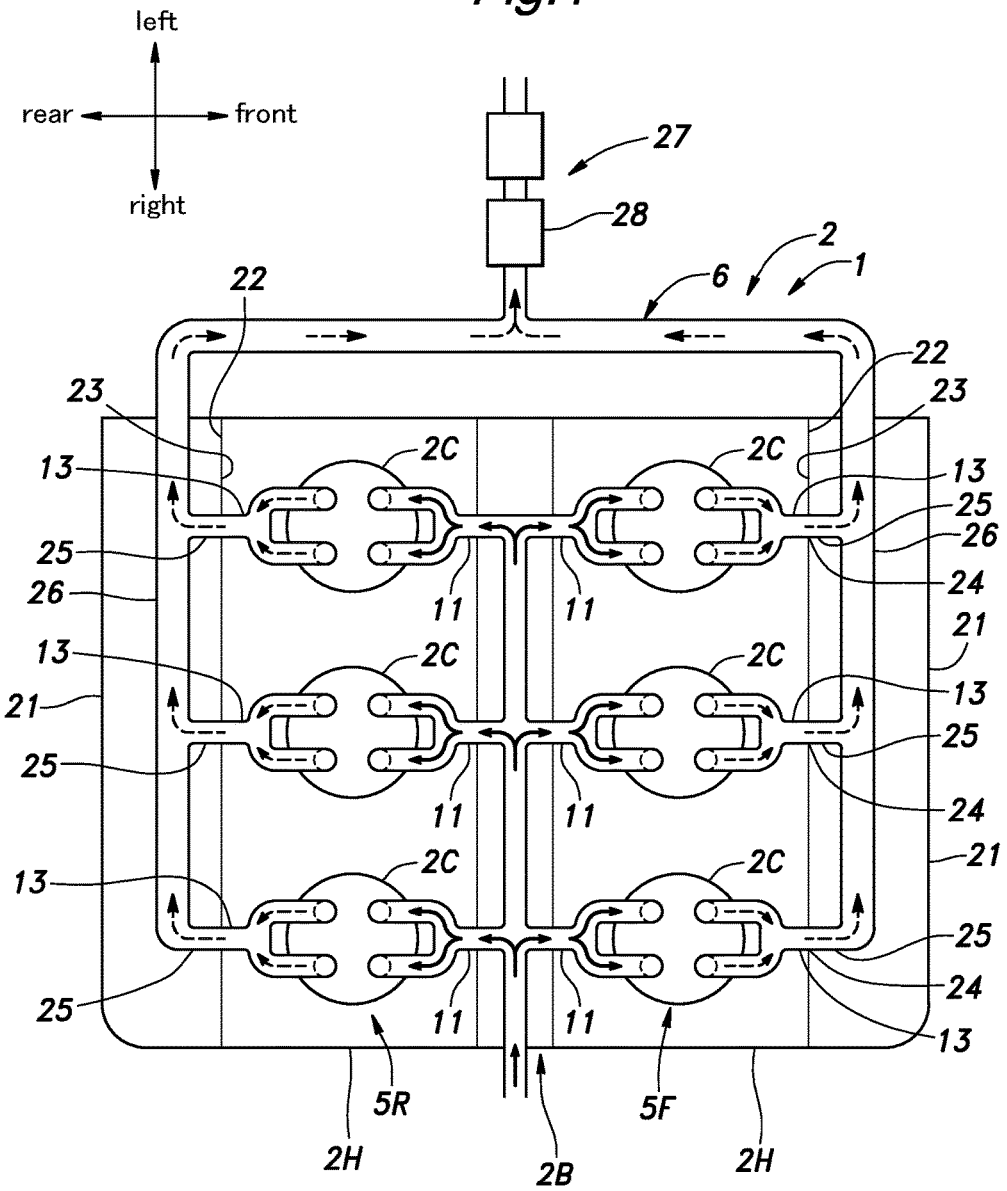
FIG. 1 is a schematic diagram of an exhaust passage of an internal combustion engine provided with a cooling water passage according to an embodiment of the present invention.

As shown in FIG. 1, an internal combustion engine 1 in this embodiment of the present invention consists of a V-type 6-cylinder engine, and includes a cylinder block 2B and two cylinder heads 2H, which jointly constitute an engine body 2. The cylinder block 2B is formed in a V-shape and includes a front bank 5F and a rear bank 5R defining a prescribed bank angle therebetween. Each of the front bank 5F and the rear bank 5R internally defines three cylinders 2C arranged in a row. The two cylinder heads 2H are mounted on the front bank 5F and the rear bank 5R, respectively (one of the cylinder heads 2H mounted on the front bank 5F may be referred to as a front cylinder head, and the other cylinder head 2H mounted on the rear bank 5R may be referred to as a rear cylinder head). The engine 1 also includes two exhaust pipes (exhaust manifolds) 21 attached to the respective cylinder heads 2H (one of the exhaust pipes 21 attached to the front cylinder head 2H may be referred to as a front exhaust pipe, and the other exhaust pipe 21 attached to the rear cylinder head 2H may be referred to as a rear exhaust pipe).

The engine 1 is provided with an exhaust passage 6 for discharging the exhaust gas generated in the cylinders 2C to outside, as shown in FIG. 1. The engine 1 is further provided with a cooling water passage 7 for cooling the cylinders 2C and the exhaust passage 6, as shown in FIG. 2.

As shown in FIG. 1, the cylinders 2C are connected with an intake passage via respective intake ports 11, which are defined in the cylinder heads 2H and each have a bifurcated downstream end connected to the corresponding cylinder 2C. Each cylinder 2C is also connected with one end (in the illustrated embodiment, a bifurcated end) of a corresponding one of exhaust ports 13 defined in the cylinder heads 2H, and the other end of each exhaust port 13 is connected with a corresponding one of exhaust branch passages 25 defined in the exhaust pipes 21. Each exhaust pipe 21 includes an exhaust merging part 26 for merging the exhaust flowing through the exhaust branch passages 25 defined therein are connected. The exhaust merging parts 26 of the two exhaust pipes 21 are connected to a collecting exhaust pipe 27 equipped with an oxidation catalyst 28.

Figure 2:
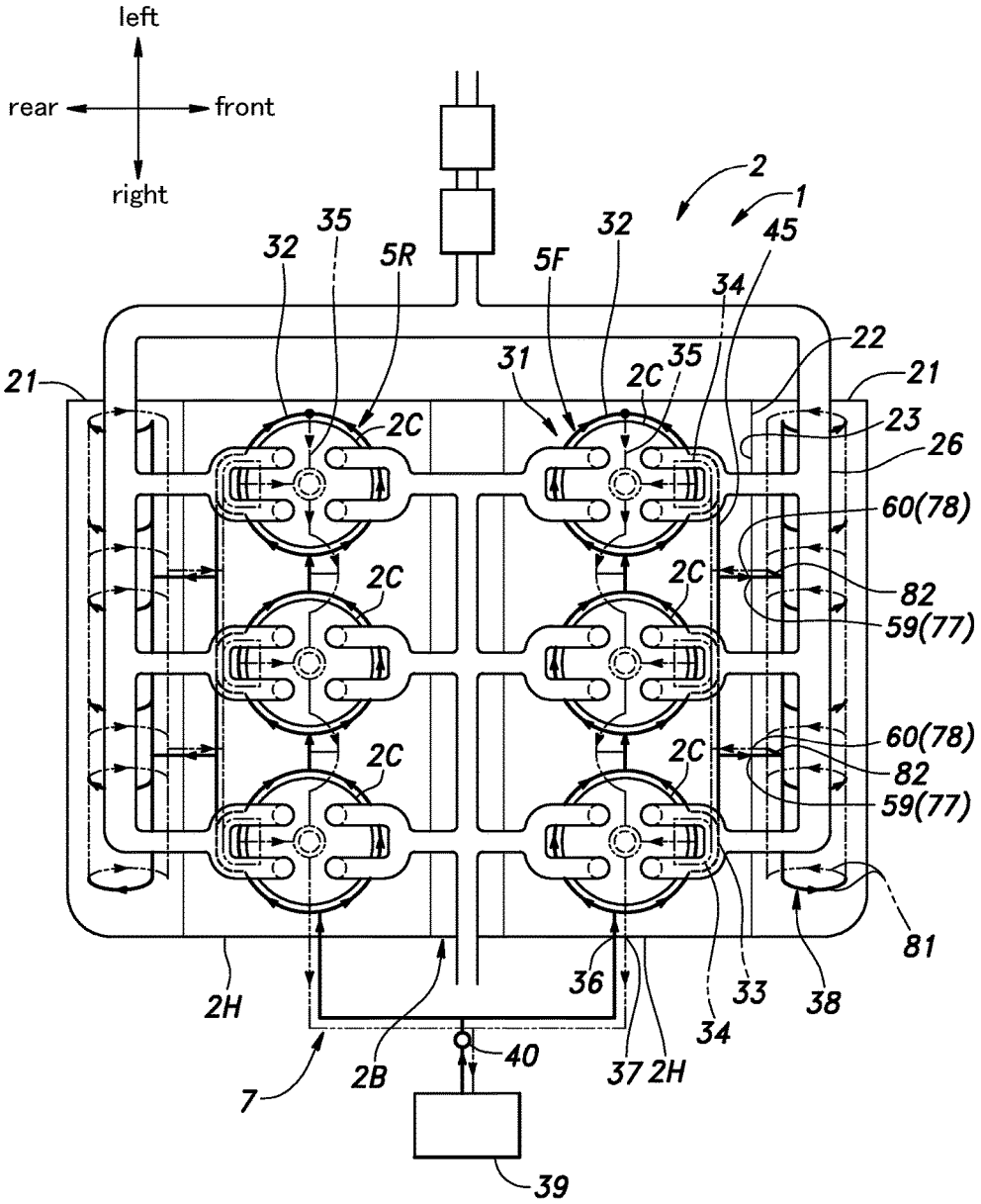
FIG. 2 is a schematic diagram of the cooling water passage according to the embodiment of the present invention.

As shown in FIG. 2, the engine body 2 is provided with an engine body cooling water passage 31 defined in each bank 5F, 5R and the cylinder head 2H attached thereto. The engine body cooling water passage 31 constitutes a part of the cooling water passage 7 and includes: a cylinder cooling water passage 32 provided with a cooling water injection port 36; a supply passage 33; a return passage 34; and a central cooling water passage 35 provided with a cooling water discharge port 37. The cylinder cooling water passage 32 is defined in the cylinder block 2B (namely, in each bank 5F, 5R) while the supply passage 33, return passage 34, and central cooling water passage 35 are defined in the cylinder head 2H. Each exhaust pipe 21 has an exhaust pipe cooling water passage 38 defined therein. The exhaust pipe cooling water passage 38 constitutes a part of the cooling water passage 7 and is connected with the engine body cooling water passage 31. The cooling water discharge port 37 is connected with a cooling water circulation passage provided with a radiator 39 and a water pump 40.

In this embodiment, the front part (namely, the front bank 5F, the front cylinder head 2H, and the front exhaust pipe 21) and the rear part (namely, the rear bank 5R, the rear cylinder head 2H, and the rear exhaust pipe 21) of the engine 1 constituting of a V-type 6-cylinder engine are substantially symmetrical with each other in structure, and thus, only the front part of the engine 1 may be described in detail in the following description.

Also, in the following description, the cylinder axis direction of the cylinders 2C of interest (namely, cylinders 2C defined in the front bank 5F) will be referred to as a vertical direction, the cylinder row direction will be referred to as a lateral direction, and the direction perpendicular to the vertical and lateral directions will be referred to as a fore-and-aft direction.

Figure 3:
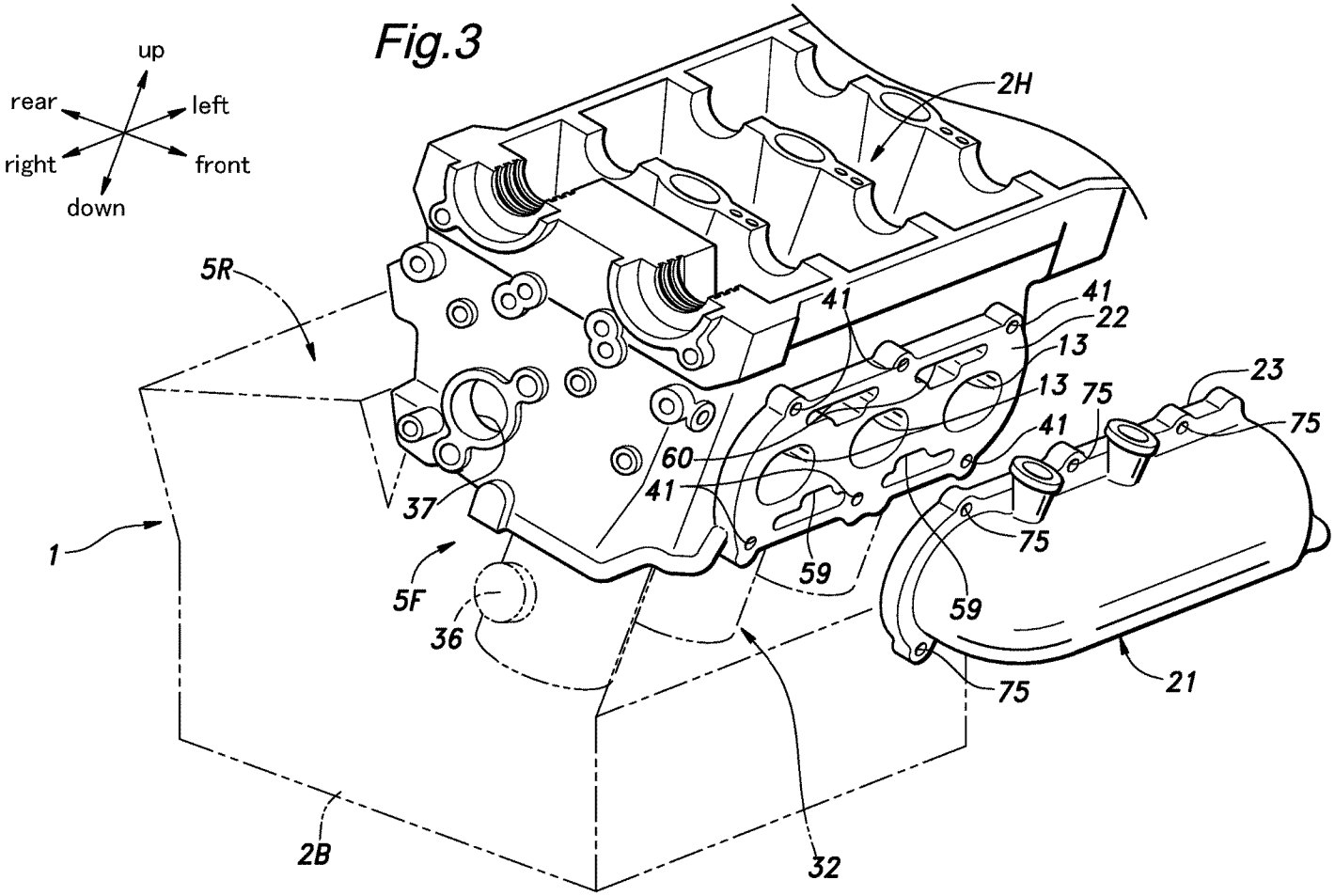
FIG. 3 is an exploded perspective view of an exhaust pipe and an engine body.

FIG. 3 is an exploded perspective view of the exhaust pipe 21 and the engine body, in which the rear cylinder head 2H and the rear exhaust pipe 21 are omitted and the cylinder block 2B is shown schematically by phantom lines. As shown in FIG. 3, the exhaust ports 13 connected to the cylinders 2C defined in the front bank 5F extend forward and open out on the front side of the cylinder head 2H. The cylinder head 2H is provided on the front side thereof with an engine body fastening surface 22 configured to be a planar surface that faces frontward, and the open ends of the exhaust ports 13 are arranged in the engine body fastening surface 22 at the same vertical position and in a row along the lateral direction (cylinder row direction). The open end of each exhaust port 13 has a track-like shape elongated in the cylinder row direction. Bolt holes 41 are formed above and below the open ends of the exhaust ports 13. It is to be noted that the cylinder head 2H attached to the rear bank 5R also is provided with an engine body fastening surface having a shape identical with that of the engine body fastening surface 22 provided to the cylinder head 2H attached to the front bank 5F.

Figure 6:
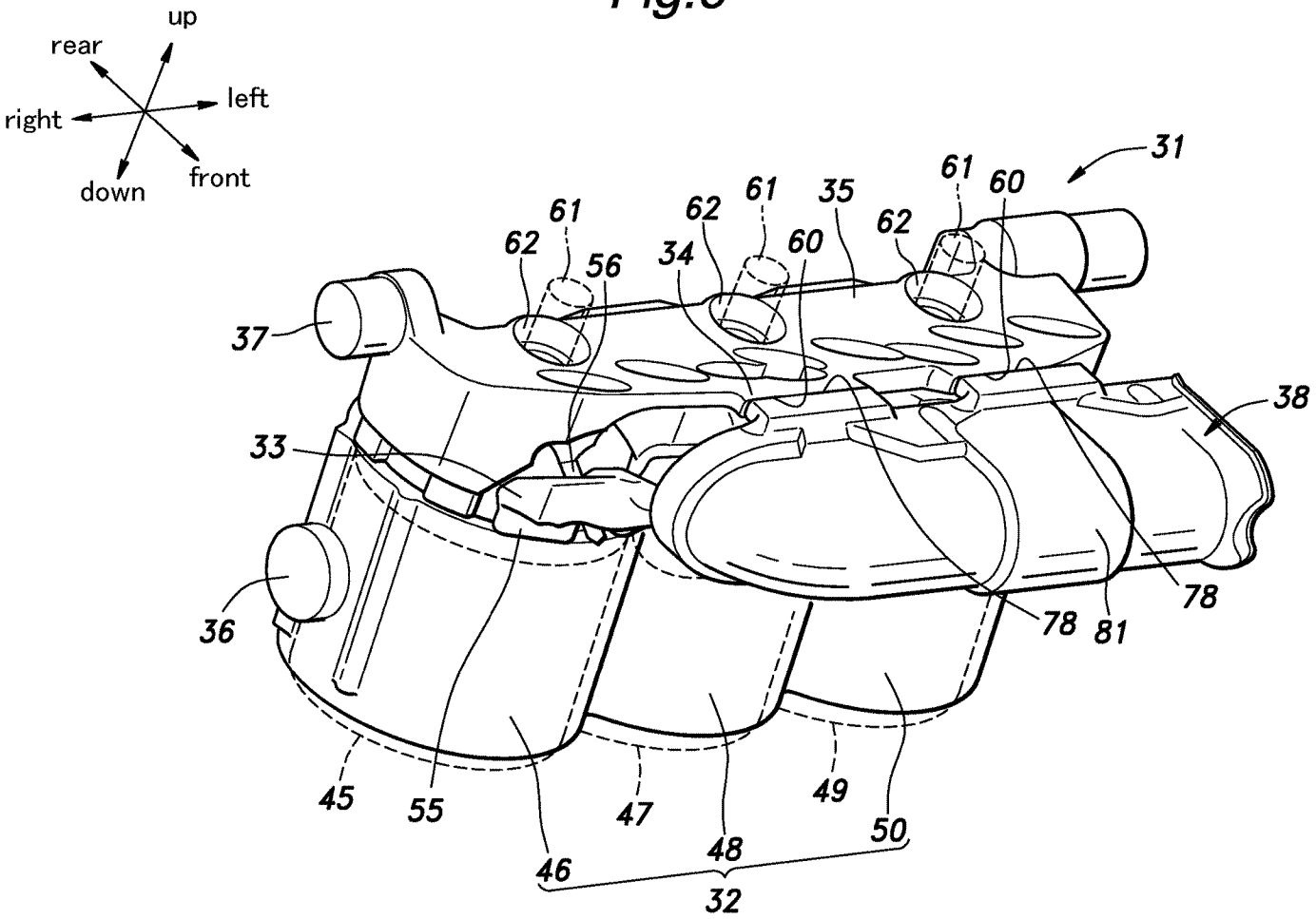
FIG. 6 is a perspective view of the cooling water passage according to the embodiment of the present invention.

As shown in FIGS. 3 and 6, the cylinder cooling water passage 32 is defined in the cylinder block 2B. The cooling water injection port 36 of the cylinder cooling water passage 32 is configured in a cylindrical shape protruding on the right side of the cylinder block 2B. The cylinder cooling water passage 32 includes a first cylinder cooling water passage 46 extending along a circumference of a first cylinder 45 that is positioned in a rightmost part of the front bank 5F, a second cylinder cooling water passage 48 extending along a circumference of a second cylinder 47 that is positioned in a middle part of the front bank 5F, and a third cylinder cooling water passage 50 extending along a circumference of a third cylinder 49 that is positioned in a leftmost part of the front bank 5F. The cooling water injection port 36 is directly connected with the first cylinder cooling water passage 46. The left ends of the front and rear parts of the first cylinder cooling water passage 46 are connected with the right ends of the front and rear parts of the second cylinder cooling water passage 48, respectively. The left ends of the front and rear parts of the second cylinder cooling water passage 48 are connected with the right ends of the front and rear parts of the third cylinder cooling water passage 50, respectively.

Figure 7:
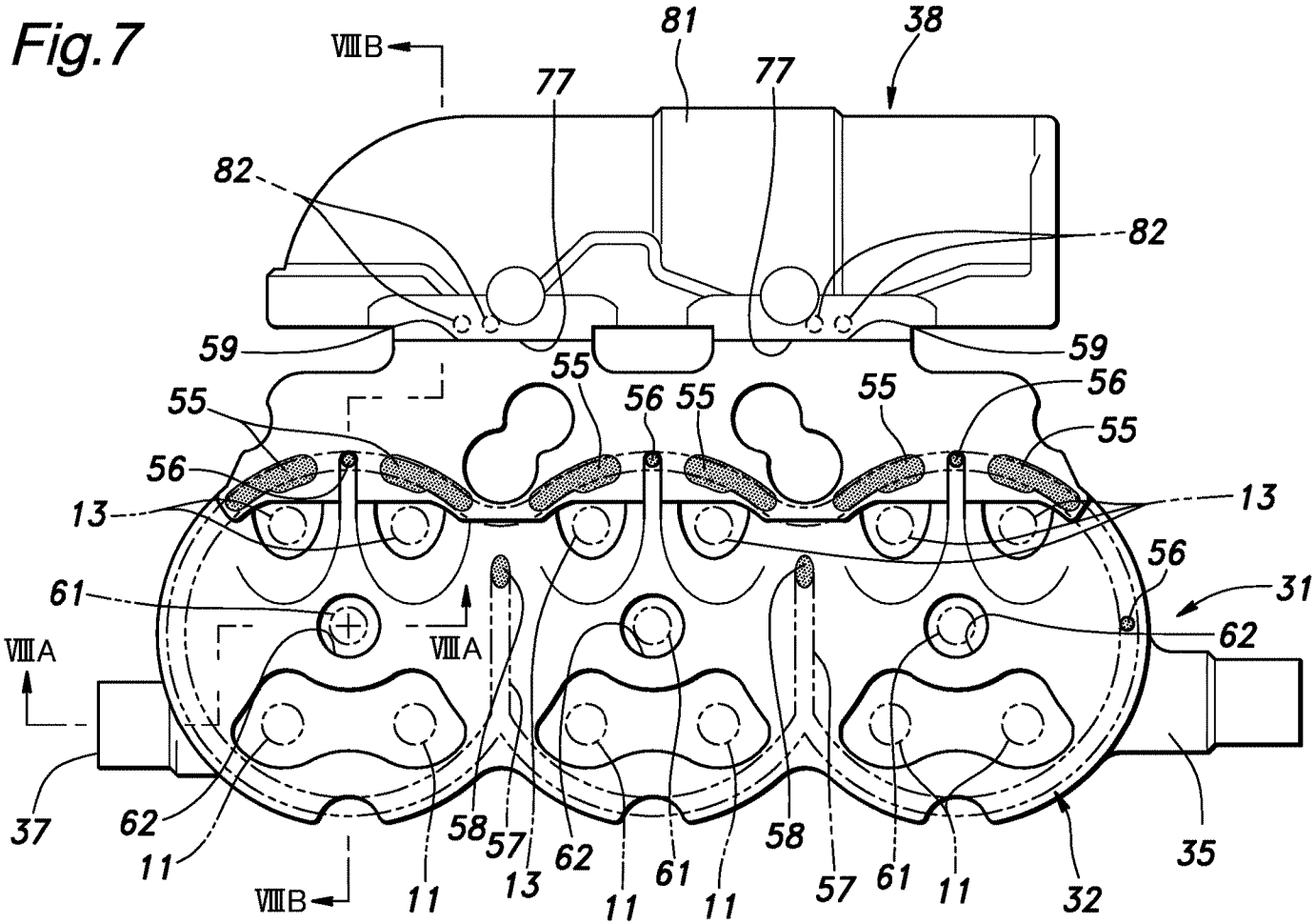
FIG. 7 is a bottom view of the cooling water passage according to the embodiment of the present invention.

As shown in FIG. 6, an upper front part of the first cylinder cooling water passage 46 is connected with the supply passage 33 by a pair of first communication paths 55 defined in the cylinder head 2H to extend upward near respective two parts of the bifurcated end portion of the related exhaust port 13. In addition, the upper front part of the first cylinder cooling water passage 46 is connected with the return passage 34 by a second communication path 56 defined in the cylinder head 2H to extend upward at a position between the two parts of the bifurcated portion of the exhaust port 13. As shown in FIG. 7, similarly to the first cylinder cooling water passage 46, an upper front part of each of the second cylinder cooling water passage 48 and the third cylinder cooling water passage 50 is connected with the supply passage 33 and the return passage 34 via a pair of first communication paths 55 and a second communication path 56, respectively. Further, an upper left part of the third cylinder cooling water passage 50 is connected with the return passage 34 via another second communication path 56. At the connection between the first cylinder cooling water passage 46 and the second cylinder cooling water passage 48, an inter-cylinder cooling water passage 57 is provided to extend from an upper end of the connecting portion between the rear part of the first cylinder cooling water passage 46 and the rear part of the second cylinder cooling water passage 48 to a vicinity of the connecting portion between the front part of the first cylinder cooling water passage 46 and the front part of the second cylinder cooling water passage 48 (also see FIG. 9). A front end of the inter-cylinder cooling water passage 57 is connected with a lower end of the supply passage 33 via a third communication path 58 defined in the cylinder head 2H. At the connection between the second cylinder cooling water passage 48 and the third cylinder cooling water passage 50, another inter-cylinder cooling water passage 57 is provided to extend from an upper end of the connecting portion between the rear part of the second cylinder cooling water passage 48 and the rear part of the third cylinder cooling water passage 50 to a vicinity of the connecting portion between the front part of the second cylinder cooling water passage 48 and the front part of the third cylinder cooling water passage 50. A front end of this inter-cylinder cooling water passage 57 is connected with the lower end of the supply passage 33 via another third communication path 58 defined in the cylinder head 2H.

Figure 8B:
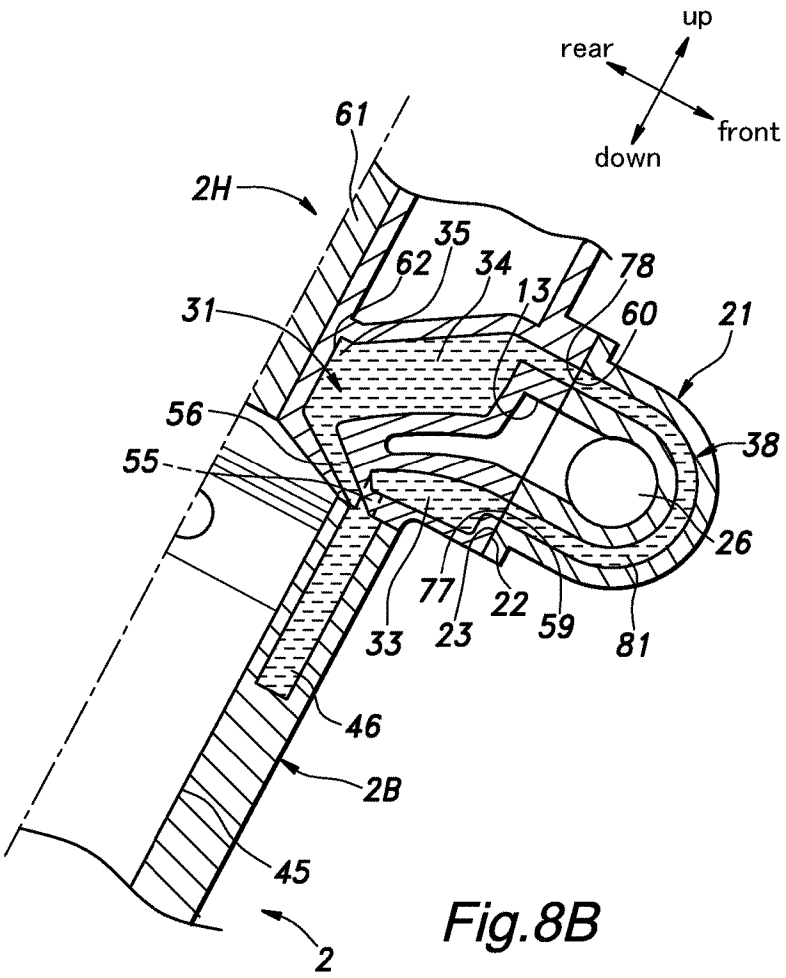
FIG. 8B is a cross-sectional view taken along line VIIIB-VIIIB in FIG. 7.

As shown in FIG. 8B, the supply passage 33 of the engine body cooling water passage 31 is defined in the cylinder head 2H, such that one end portion thereof is connected with the front upper part of the cylinder cooling water passage 32 (such as the first cylinder cooling water passage 46) via the first communication paths 55. The supply passage 33 is defined below the exhaust ports 13, and extends frontward and upward along the lower side of the exhaust ports 13. The other end portion of the supply passage 33 is connected with two cooling water supply openings 59 (also see FIGS. 3 and 9) that open out in the engine body fastening surface 22. Each cooling water supply opening 59 is formed below a part between a corresponding adjoining pair of open ends of the exhaust ports 13. The supply passage 33 is connected with the exhaust pipe cooling water passage 38 via the cooling water supply openings 59.

The return passage 34 of the engine body cooling water passage 31 is defined in the cylinder head 2H, such that one end portion thereof is connected with two cooling water return openings 60 that open out in the engine body fastening surface 22. The return passage 34 is provided above the exhaust ports 13, and extends rearward along the upper side of the exhaust ports 13. The other end portion of the return passage 34 is connected with the central cooling water passage 35. Each cooling water return opening 60 is formed above a part between a corresponding pair of adjoining open ends of the exhaust ports 13. The cooling water supply openings 59 and the cooling water return openings 60 are formed to be vertically symmetrical in shape with each other. The exhaust pipe cooling water passage 38 is connected with the return passage 34 via the cooling water return openings 60.

Figure 9:
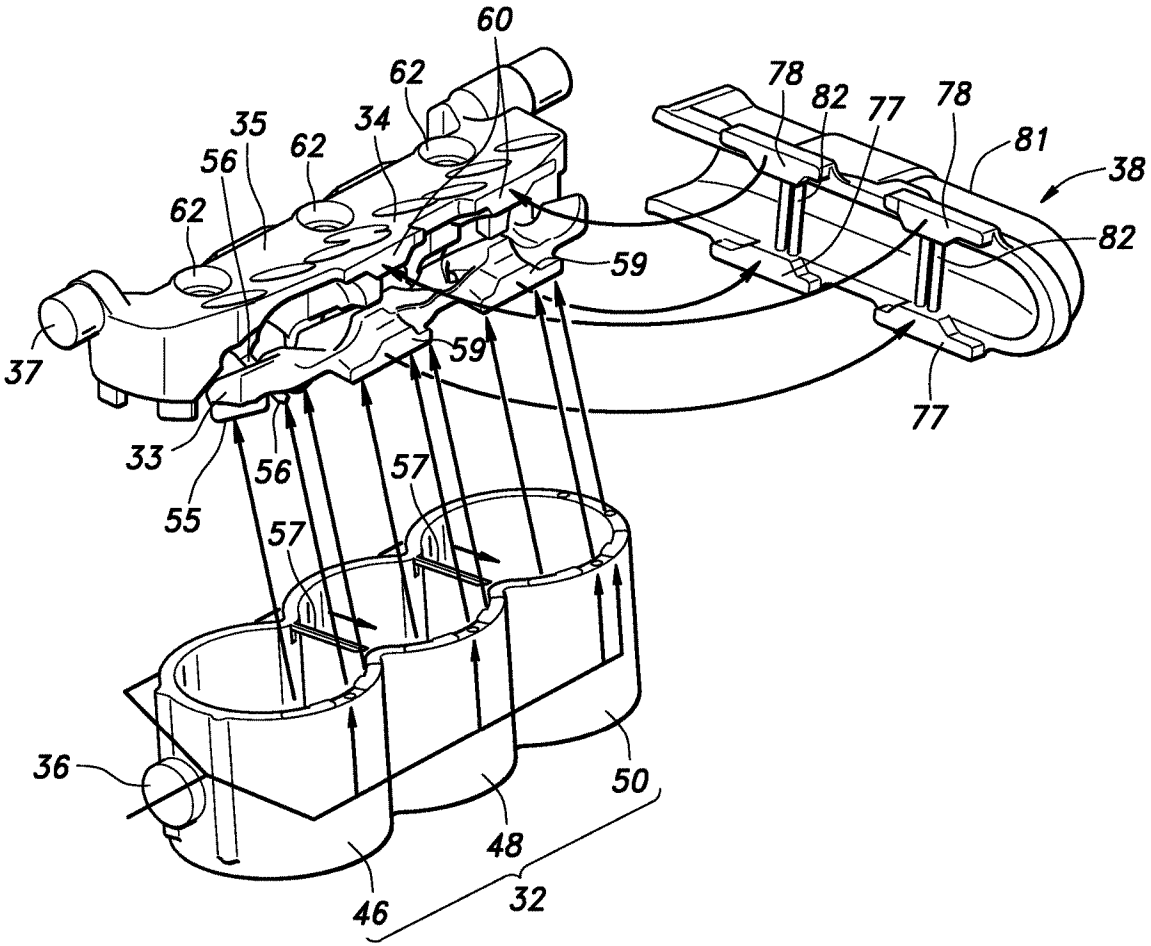
FIG. 9 is a perspective view showing the flow of cooling water in the engine body cooling water passage and the exhaust pipe cooling water passage regarding the embodiment of the present invention.

As shown in FIGS. 6, 7, and 9, the central cooling water passage 35 is defined in the cylinder head 2H to extend in the lateral direction (cylinder row direction). The central cooling water passage 35 has spark plug through-holes 62 to circumvent the spark plugs 61 mounted in the cylinder head 2H for the respective cylinders 2C. As shown in FIG. 7, the central cooling water passage 35 is defined to collectively surround the two parts of the bifurcated end portion of each of the intake ports 11 respectively connected with the three cylinders 2C. As shown in FIGS. 6 and 9, the right end portion of the central cooling water passage 35 is bent upward and then extends to the right to be connected with the cooling water discharge port 37 defined by a tube-like part that protrudes on the right face of the cylinder head 2H. The cooling water discharge port 37 is located at a higher position than the cooling water injection port 36.

Figure 4:
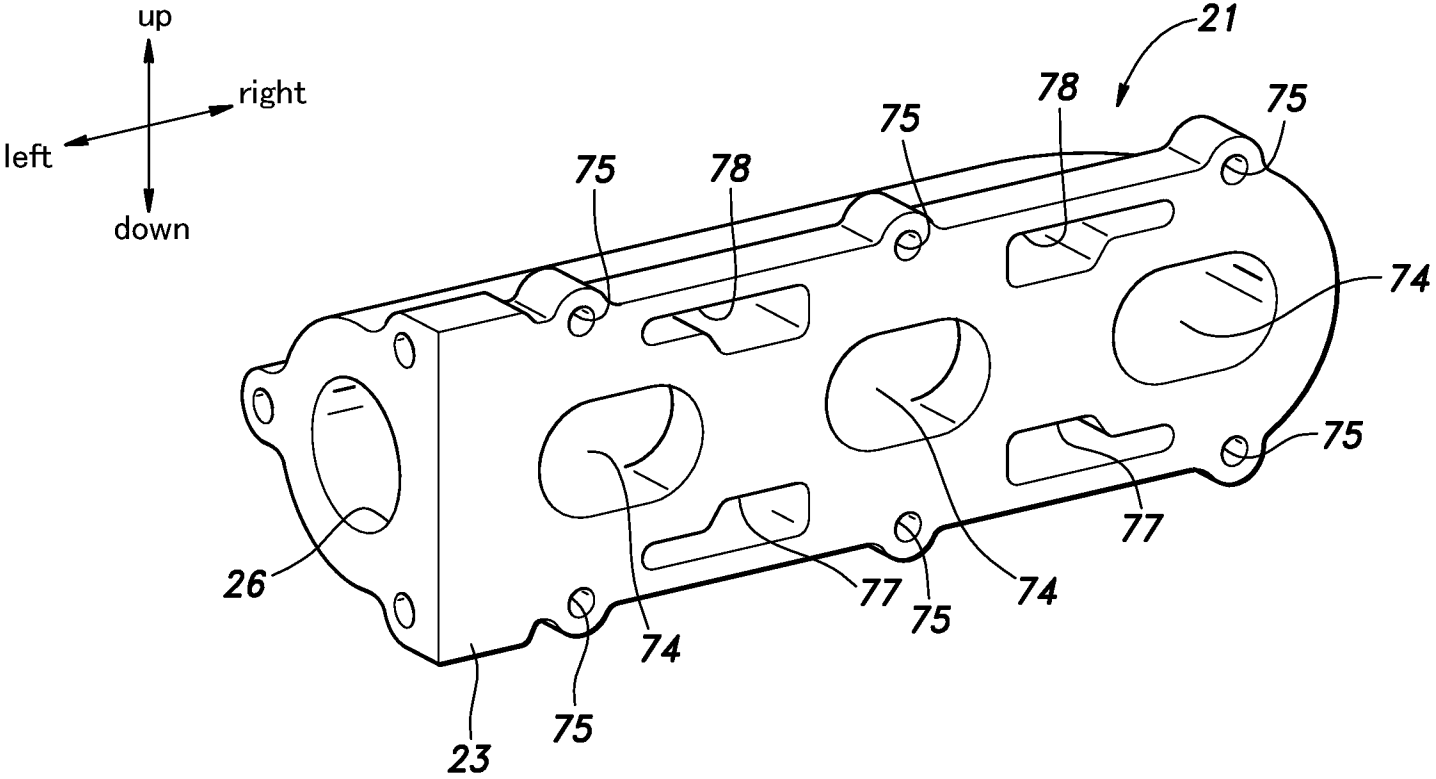
FIG. 4 is a perspective view of an exhaust pipe.

As shown in FIGS. 3 and 4, the exhaust pipe 21 fastened to the cylinder head 2H mounted on the front bank 5F of the cylinder block 2B is provided on a rear side thereof with an exhaust pipe fastening surface 23, such that the engine body fastening surface 22 and the exhaust pipe fastening surface 23 abut on each other when the exhaust pipe 21 is fastened to the cylinder head 2H. The exhaust pipe 21 has a flange defining an outer peripheral part of the exhaust pipe fastening surface 23, and the flange is provided with bolt-through holes 75, such that bolts passed through the bolt-through holes 75 threadably engage the bolt holes 41 formed in the engine body fastening surface 22 to fasten the exhaust pipe 21 to the cylinder head 2H.

Figure 5A:
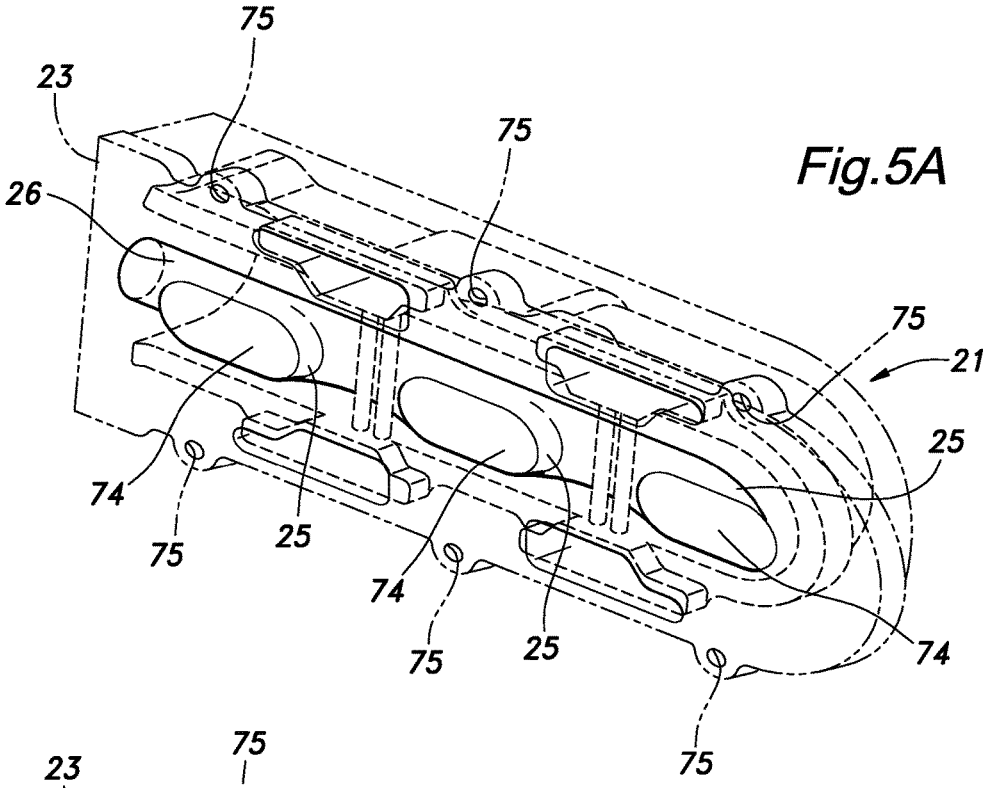
FIGS. 5A and 5B are transparent perspective views respectively showing an exhaust passage and a cooling water passage of the exhaust pipe.

As shown in FIG. 4 and FIG. 5A, the exhaust pipe 21 has three exhaust branch passages 25. Each exhaust branch passage 25 has an exhaust inlet 74 that opens out in the exhaust pipe fastening surface 23. The exhaust inlets 74 are formed to be aligned vertically and arranged laterally. Each exhaust inlet 74 has a track-like shape elongated in the cylinder row direction. The bolt-through holes 75 are formed in the exhaust pipe fastening surface 23 at positions above and below the exhaust inlets 74.

As mentioned above, the exhaust pipe 21 includes the exhaust merging part 26 formed as a passage for merging exhaust flowing through the exhaust branch passages 25. The exhaust branch passage 25 located rightmost when the exhaust pipe 21 is attached to the front cylinder head 2H extends in the exhaust pipe 21 forward and leftward from the corresponding exhaust inlet 74 and is connected with the exhaust merging part 26. The exhaust branch passages 25 located at the middle and leftmost each extend in the exhaust pipe 21 rearward and are connected with the exhaust merging part 26. The exhaust merging part 26 is formed to extend laterally and opens out in the left side face of the exhaust pipe 21. The exhaust pipe 21 has a vertically symmetrical shape. It is to be noted that the rear exhaust pipe 21 fastened to the rear cylinder head 2H mounted to the rear bank 5R has an identical shape as the front exhaust pipe 21 fastened to the front cylinder head 2H but is positioned upside down relative to the front exhaust pipe 21.

Figure 5B:
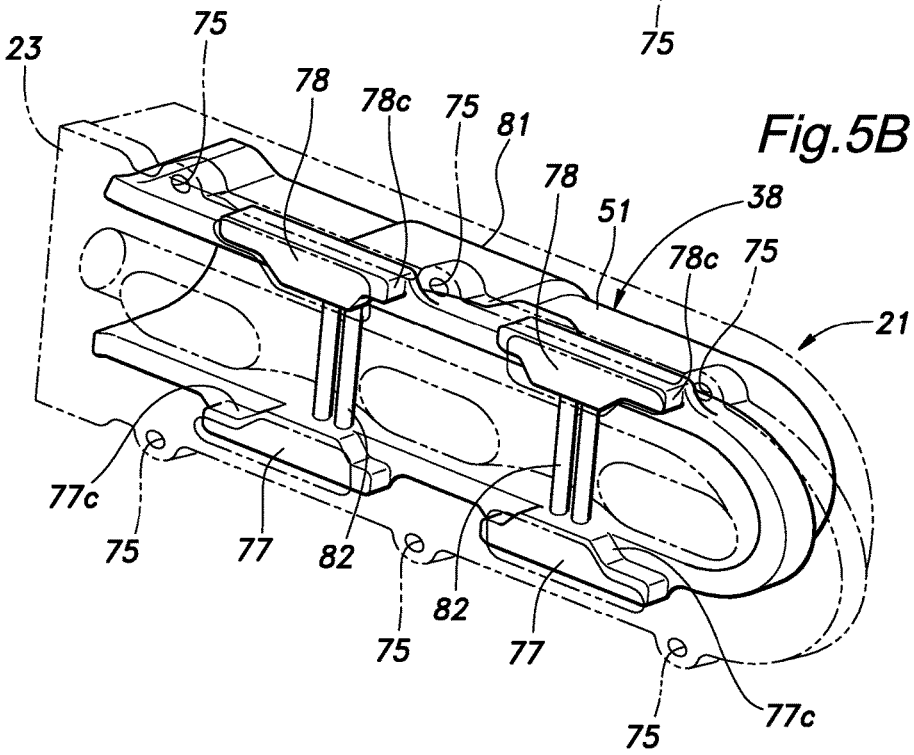

As shown in FIG. 5B, the exhaust pipe 21 internally defines the exhaust pipe cooling water passage 38 that is in communication with the supply passage 33 and the return passage 34 when the exhaust pipe 21 is fastened to the cylinder head 2H. The exhaust pipe cooling water passage 38 includes multiple cooling water inlets 77 and multiple cooling water outlets 78 that open out in the exhaust pipe fastening surface 23. In the present embodiment, two cooling water inlets 77 and two cooling water outlets 78 are formed in the exhaust pipe fastening surface 23. Each cooling water inlet 77 is located below a part between a corresponding pair of adjoining exhaust inlets 74. Each cooling water outlet 78 is located above a part between a corresponding pair of adjoining exhaust inlets 74. The cooling water inlets 77 and the cooling water outlets 78 are formed to be vertically symmetrical in shape with each other. The exhaust pipe cooling water passage 38 is connected with the supply passage 33 via the cooling water inlets 77, and is connected with the return passage 34 via the cooling water outlets 78.

As shown in FIGS. 5B, 6 and 9, the exhaust pipe cooling water passage 38 includes an exhaust merging part cooling water passage 81 that has a lateral dimension substantially the same as or slightly larger than that of the exhaust merging part 26 and extends vertically along the front side of the exhaust merging part 26 apart from the engine body fastening surface 22. The exhaust merging part 26 is provided between the exhaust merging part cooling water passage 81 and the engine body fastening surface 22. The exhaust merging part cooling water passage 81 includes a part that extends along the front right side of the rightmost exhaust branch passage 25. The exhaust pipe cooling water passage 38 includes cooling water inlet connecting parts 77C that connect the lower end of the exhaust merging part cooling water passage 81 with the cooling water inlets 77. Each cooling water inlet connecting part 77C extends in the fore-and-aft direction and has a substantially trapezoidal cross-section. The exhaust pipe cooling water passage 38 further includes cooling water outlet connecting parts 78C that connect the upper end of the exhaust merging part cooling water passage 81 with the cooling water outlets 78. Each cooling water outlet connecting part 78C extends in the fore-and-aft direction and has a substantially trapezoidal cross-section.

The exhaust pipe cooling water passage 38 further includes sets of inter-branch cooling water passages 82 each extending vertically, such that each pair of vertically aligned cooling water inlet connecting part 77C and cooling water outlet connecting part 78C are connected with each other by a set of inter-branch cooling water passages 82 that are arranged in the cylinder row direction. Each set of inter-branch cooling water passages 82 are positioned to pass between a corresponding pair of adjoining exhaust branch passages 25. In this embodiment, each set of inter-branch cooling water passages 82 includes two inter-branch cooling water passages 82, and the exhaust pipe 21 (exhaust pipe cooling water passage 38) includes two sets of inter-branch cooling water passages 82.

As shown in FIGS. 5B and 6, the exhaust merging part cooling water passage 81 is formed to have a larger thickness at a laterally central part thereof. As the left end of the exhaust merging part cooling water passage 81 is distant from the cooling water injection port 36 and the cooling water discharge port 37, the flow rate of the cooling water tends to be low in that part. In order to ensure a sufficient flow rate or flow velocity at various positions in the exhaust merging part cooling water passage 81, the thickness of the exhaust merging part cooling water passage 81 is varied depending on the positions.

Figure 8A:
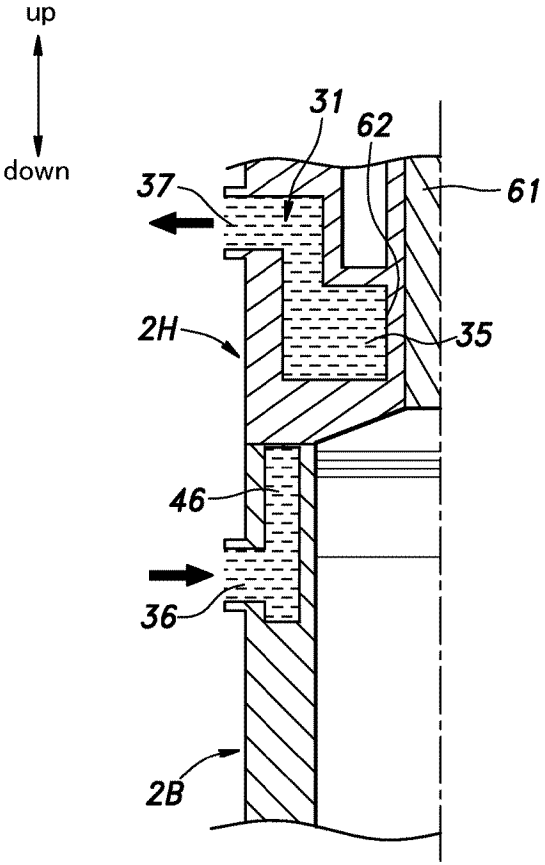
FIG. 8A is across-sectional view taken along line VIIIA-VIIIA in FIG. 7.

Next, description will be made of an operation of the engine 1 provided with the cooling water passage 7 according to the present embodiment. As shown in FIGS. 8A and 9, cooling water is injected through the cooling water injection port 36 at a prescribed pressure, and flows into the first cylinder cooling water passage 46. The cooling water that has flowed into the first cylinder cooling water passage 46 flows into the supply passage 33 (via the first communication paths 55), the return passage 34 (via the second communication path 56), and the second cylinder cooling water passage 48. The cooling water that has flowed into the second cylinder cooling water passage 48 flows into the third cylinder cooling water passage 50, the supply passage 33, and the return passage 34. The cooling water that has flowed into the third cylinder cooling water passage 50 flows into the supply passage 33 and the return passage 34. As shown in FIGS. 6 and 7, the cooling water that has flown into the inter-cylinder cooling water passage 57 via the connecting portion between the first cylinder cooling water passage 46 and the second cylinder cooling water passage 48 flows into the supply passage 33 via the relevant third communication path 58. The cooling water that has flow into the inter-cylinder cooling water passage 57 via the connecting portion between the second cylinder cooling water passage 48 and the third cylinder cooling water passage 50 also flows into the supply passage 33 via the relevant third communication path 58.

As shown in FIG. 8B, the cooling water that has reached the supply passage 33 flows upward from the lower part of the supply passage 33 while cooling the lower part of the exhaust ports 13, and reaches the cooling water supply openings 59. The cooling water that has reached the cooling water supply openings 59 flows into the exhaust pipe cooling water passage 38 of the exhaust pipe 21 via the cooling water inlets 77. A large part of the cooling water that has entered the exhaust pipe cooling water passage 38 flows into the exhaust merging part cooling water passage 81 and the remaining part of the same flows into the inter-branch cooling water passages 82 (not shown in FIG. 8B). The cooling water flowing through the exhaust merging part cooling water passage 81 passes below the exhaust branch passages 25, which are connected with the openings of the exhaust ports 13, and below the exhaust merging part 26, and further flows upward along the front face of the exhaust merging part 26 to reach above the exhaust merging part 26. While passing below the exhaust branch passages 25 and the exhaust merging part 26, the cooling water cools the part of the exhaust pipe 21 defining the lower part of the exhaust branch passages 25 and the exhaust merging part 26. The cooling water flowing through the exhaust merging part cooling water passage 81 cools the part of the exhaust pipe 21 defining the exhaust merging part 26. The cooling water that has reached above the exhaust merging part 26 passes over the exhaust branch passages 25 and the exhaust merging part 26, and reaches the cooling water outlets 78. While passing over the exhaust branch passages 25 and the exhaust merging part 26, the cooling water cools the part of the exhaust pipe 21 defining the upper part of the exhaust branch passages 25 and the exhaust merging part 26. The cooling water that has flown into the inter-branch cooling water passages 82 flows upward to the cooling water outlets 78.

The cooling water that has reached the cooling water outlets 78 flows into the return passage 34 through the cooling water return openings 60. The cooling water that has entered the return passage 34 flows from front to rear along an upper part of the exhaust ports 13 to the central cooling water passage 35. While passing through the return passage 34, the cooling water cools the part of the cylinder head 2H defining the upper part of the exhaust port 13. Part of the cooling water that has entered the first cylinder cooling water passage 46 flows into the return passage 34 via the second communication paths 56. The cooling water that has entered the return passage 34 via the second communication paths 56 also flows from front to rear to reach the central cooling water passage 35. The cooling water that has entered the central cooling water passage 35 flows from left to right through the central cooling water passage 35. As shown in FIG. 7, the cooling water passing through the central cooling water passage 35 flows along the periphery of the intake ports 11 and the spark plugs 61 and reaches the cooling water discharge port 37.

Next, effects of the engine 1 provided with the cooling water passage 7 according to the present embodiment will be described. Because the supply passage 33 and the return passage 34 eliminate the need for the passages to supply cooling water directly to the exhaust pipe 21 and to discharge cooling water directly from the exhaust pipe 21, the structure of the cooling water passage 7 of the engine 1 can be simplified.

The supply passage 33 and the return passage 34 open out in the engine body fastening surface 22, and the exhaust pipe cooling water passage 38 opens out in the exhaust pipe fastening surface 23, such that exhaust pipe cooling water passage 38 is connected with the supply passage 33 and the return passage 34. Thus, because the cooling water can flow via the engine body fastening surface 22 and the exhaust pipe fastening surface 23, the structure of the cooling water passage 7 of the engine 1 can be even more simplified.

As the exhaust merging part 26 is provided between the exhaust merging part cooling water passage 81 and the engine body 2, the part of the exhaust pipe 21 defining the exhaust merging part 26 can be cooled efficiently by the cooling water flowing through the exhaust merging part cooling water passage 81. Also, because the inter-branch cooling water passages 82, which are provided between adjoining exhaust branch passages 25, are configured to pass between the exhaust merging part 26 and the engine body 2, the parts defining the exhaust branch passages 25 can be cooled by the cooling water flowing through the inter-branch cooling water passages 82. The cooling water flowing through the cooling water passage formed to cover the right side of the rightmost exhaust branch passage 25 cools the part of the exhaust pipe 21 defining the right side of the rightmost exhaust branch passage 25. Each exhaust branch passage 25 has an elongated cross section, and thus, compared to a case where each exhaust branch passage 25 has a circular cross section, the inter-branch cooling water passages 82 are located closer to the heat source, namely, the exhaust flowing through the exhaust branch passages 25. The arrangement of the inter-branch cooling water passages 82 close to the heat source allows the parts defining the exhaust branch passages 25 to be cooled efficiently. In the case where multiple inter-branch cooling water passages 82 are provided between each pair of adjoining exhaust branch passages 25, the parts defining the exhaust branch passages 25 can be cooled even more efficiently.

The cooling water injection port 36, the supply passage 33, the return passage 34, and the cooling water discharge port 37 are positioned in this order from below, and therefore, the engine body cooling water passage 31 and the exhaust pipe cooling water passage 38 can be filled with cooling water from below, and this prevents bubbles from being generated or staying in the engine body cooling water passage 31 and the exhaust pipe cooling water passage 38.

The exhaust pipe 21 has a vertically symmetrical shape. Therefore, two exhaust pipes 21 having an identical shape can be fastened to opposite sides of the engine body 2, respectively, such that the exhaust merging parts 26 of the two exhaust pipes 21 opening in the same direction (leftward, in the illustrated embodiment), by positioning one of the exhaust pipes 21 upside down.

The exhaust pipe 21 is fastened to the cylinder head 2H by means of the bolts passed through the bolt-through holes 75 provided above and below the exhaust branch passages 25 and engaged with the bolt holes 41 formed above and below the exhaust ports 13, and this improves the sealing performance of the connecting part between the exhaust ports 13 and the exhaust branch passages 25.

The concrete embodiment has been described in the foregoing, but the present invention is not limited to the foregoing embodiment and various alterations and modifications are possible without departing from the scope of the present invention. For example, in the foregoing embodiment, the engine 1 consists of a V-type 6-cylinder engine, but the engine 1 may be any reciprocating engine, and any number of cylinders in any arrangement may be used. In the foregoing embodiment, the exhaust merging part 26 opens leftward, but the exhaust merging part 26 may open rightward.

In the foregoing embodiment, the cooling water flowing between the engine body 2 and the exhaust pipe 21 passes through the engine body fastening surface 22 and the exhaust pipe fastening surface 23, but the engine body cooling water passage 31 and the exhaust pipe cooling water passage 38 may be connected with each other by pipes separate from the engine body 2 and the exhaust pipe 21.

The invention claimed is:

1. An internal combustion engine, comprising:

an engine body;

an exhaust pipe fastened to the engine body;

an engine body cooling water passage provided in the engine body and having a cooling water injection port and a cooling water discharge port;

an exhaust pipe cooling water passage provided in the exhaust pipe;

a supply passage that connects the engine body cooling water passage with the exhaust pipe cooling water passage such that cooling water flows from the engine body cooling water passage to the exhaust pipe cooling water passage through the supply passage; and a return passage that connects the engine body cooling water passage with the exhaust pipe cooling water passage such that the cooling water flows from the exhaust pipe cooling water passage to the engine body cooling water passage through the return passage, wherein:

the supply passage is provided at a higher position than the cooling water injection port in a cylinder axis direction;

the return passage is provided at a higher position than the supply passage in the cylinder axis direction; and the cooling water discharge port is provided at a higher position than the return passage in the cylinder axis direction.

2. The internal combustion engine according to claim 1, wherein:

the engine body includes an engine body fastening part fastened to the exhaust pipe and at least one exhaust port opening out in the engine body fastening part;

the exhaust pipe includes an exhaust pipe fastening part fastened to the engine body and at least one exhaust branch passage that opens out in the exhaust pipe fastening part and is in communication with the at least one exhaust port;

the supply passage and the return passage are included in the engine body cooling water passage;

the supply passage and the return passage open out in the engine body fastening part; and the exhaust pipe cooling water passage opens out in the exhaust pipe fastening part and is connected with the supply passage and the return passage.

3. The internal combustion engine according to claim 2, wherein:

the at least one exhaust port includes a plurality of exhaust ports each opening out in the engine body fastening part;

the at least one exhaust branch passage includes a plurality of exhaust branch passages each opening out in the exhaust pipe fastening part and being in communication with a corresponding one of the exhaust ports;

the exhaust branch passages are arranged along a cylinder row direction;

the exhaust pipe includes an exhaust merging part for merging exhaust flowing through the plurality of exhaust branch passages; and the exhaust merging part is provided between the exhaust pipe cooling water passage and the engine body.

4. The internal combustion engine according to claim 3, wherein the exhaust pipe cooling water passage further includes at least one inter-branch cooling water passage between each pair of adjoining exhaust branch passages.

5. The internal combustion engine according to claim 4, wherein the at least one inter-branch cooling water passage is configured to pass between the exhaust merging part and the engine body.

6. The internal combustion engine according to claim 1, wherein the exhaust pipe has a vertically symmetrical shape.

* * * * *